US005722284A

United States Patent [19]

Linsmeyer

[11] Patent Number: 5,722,284

[45] Date of Patent: Mar. 3, 1998

[54] CRIMPING TOOL

[75] Inventor: Louis R. Linsmeyer, Hustisford, Wis.

[73] Assignee: Tru-Fire Corporation, North Fond du Lac, Wis.

[21] Appl. No.: 659,538

[22] Filed: Jun. 6, 1996

Related U.S. Application Data

[63] Continuation of Ser. No. 308,671, Sep. 19, 1994, abandoned.

[51] Int. Cl.[6] ..... H01R 43/042

[52] U.S. Cl. ..... 72/409.14; 72/409.01; 29/751

[58] Field of Search ..... 72/409.01, 409.12, 72/409.13, 409.14, 409.19, 412; 29/751; 81/427.5, 426.5, 419

[56] References Cited

U.S. PATENT DOCUMENTS

| | | | |
|---|---|---|---|
| 1,327,892 | 1/1920 | Viertels | 72/410 |
| 1,399,665 | 12/1921 | Shapiro | 72/409 |
| 2,009,829 | 7/1935 | Williams | 72/409 |
| 2,731,862 | 1/1956 | Schinske | 72/410 |
| 2,763,171 | 9/1956 | Modrey | 72/410 |
| 2,832,244 | 4/1958 | Olson | 72/409 |
| 2,952,175 | 9/1960 | Edlen | 72/409 |
| 4,604,890 | 8/1986 | Martin | 72/410 |
| 4,724,729 | 2/1988 | Oetiker | 72/410 |
| 5,138,864 | 8/1992 | Tarpill | 72/410 |

*Primary Examiner*—Daniel C. Crane
*Attorney, Agent, or Firm*—Robert C. Curfiss; Mark A. Tidwell; Bracewell & Patterson

[57] ABSTRACT

A crimping tool with a pliers-like lever action includes a jaw portion constructed of interleaving plates for surrounding the crimp element and applying a uniform crimping force when the tool is closed in a lever action. The crimp receiving notches are of a deep "v" configuration to maximize application of the lever force to the crimp element. An integral decrimping tool permits non-destructive removal of a crimp from an crimp/receiver assembly.

11 Claims, 4 Drawing Sheets

CRIMPING TOOL

This is a Continuation of application Ser. No. 08/308,671 filed on Sep. 19, 1994, now abandoned.

BACKGROUND OF THE INVENTION

1. Field of Invention

The subject invention is generally related to tools for crimping ring or split-ring type fasteners, and is specifically directed to a laminated crimping tool with interleaving crimping jaws.

2. Discussion of the Prior Art

Crimping tools are well known in the art and are used for many purposes. One of the best known uses is as a device for mechanically securing a fastener to an electrical wire or cable. Typically, one end of the fastener is formed of a cylindrical, hollow sleeve, and the other end is an eyelet, pin or socket or similar fastener element. The sleeve is adapted for receiving an end of the wire or cable and is clamped thereon by deforming the sleeve through use of a crimping tool.

Another common use of the crimping tool is to secure nock rings on a bow string. In this application, the hock ring is a split ring having a through slit by which the ring may be placed on the bow string. The ring is then clamped in place on the bow string by use of the crimping tool.

It is desirable that the crimping force applied to the fastener or ring be sufficient to substantially permanently secure the element to the wire, cable or string. Further, good conductive contact is essential in the case of electrical applications, and the ring must not move from position in the case of applications such as nock mounting, where the hock forms a rest for an arrow and must be maintained in position in order to properly seat the arrow.

Further, it is desirable that the crimped ring or fastener be uniformly secured to the periphery of the receiving member. In addition, particularly with respect to nock rings, it is desirable that the crimped ring be removable with minimum damage to the bow string.

Known crimping devices have several shortcomings and provide a less than optimum crimp element and receiving member assembly. For example, crimping tools of the prior art do not sufficiently surround the crimp element to permit an equal application of force to the element for assuring uniform contact and anchoring of the element around the periphery of the receiving member. In addition, in most applications, the crimping tool does not apply equally distributed diametrically opposed or radial force, causing the element to cock off center during the crimping process. This often leads to an inadequate or ineffective connection, possibly jeopardizing the securing function and, where applicable, providing a less than optimum electrical contact.

Also, there are not any known crimping tools that include integral devices for effectively removing assembled crimp elements from the receiving member in a non-destructive manner.

SUMMARY OF THE INVENTION

The subject invention is directed to a crimping tool having a novel jaw assembly adapted for substantially surrounding the crimp element in order to apply a uniform force about the element during the crimping operation. The jaw includes crimp element receiving notches uniquely configured to maximize the forces applied on the element to facilitate the crimping action. In addition, where desired, an integral removal tool may be included on the crimping tool for non-destructive removal of a mounted crimp element.

In the preferred embodiment of the invention the crimping tool is a pliers-like assembly made of laminated elements, wherein the opposite lever handles and jaws are layered and assembled in an interleaving relationship. The interleaving jaws include crimp element receiving notches for firmly seating the element, with the interleaving layers substantially and uniformly surrounding the element. This provides a uniform application of force on the element when the jaws are closed in a clamping, levered action. In addition, the notches are specifically configured to maximize the force on the element as the jaws are closed, by incorporating a deep "v" design. In the preferred configuration, each handle/jaw member comprises a plurality of laminated layers, separated by spacers, with the laminated layers of the other handle jaw member being interleaved to provide and interleaving assembly. The interleaving jaw areas are of sufficient depth or thickness to fully engage the crimp area of the crimp element. Where desired, a plurality of notches may be provided for accommodating a variety of different sized crimp elements.

The jaw and notch design provide uniform distribution of the crimping forces in both the axial and radial directions of the crimp element, assuring a good, uniform crimping force for securing the crimp element to the receiving member.

The preferred embodiment of the invention can include an integral removal tool mounted on one of the handles of the crimping tool. In its preferred configuration, the removal tool includes a lever having an engagement end extending above the top handle and is easily engaged by the thumb when the crimping tool is held in the normal operational manner. A notch area is provided between the handles and behind the jaw and pivot point, and is adapted for receiving an assembled crimp element and receiving member. A nipple extends from the upper handle 10 engages the crimp element, with the lever having a lower end positioned in advance of the nipple, also for engaging the crimping element. When the jaws are in the closed position, the thumb can be used to engage and pull back on the lever to separate the lower lever end from the nipple and spread the crimp element apart, permitting its removal from the receiving element in a non-destructive manner.

It is, therefore, an object and feature of the subject invention to provide a crimping tool that applies a uniformly distributed crimping force over the body of a crimp element.

It is another object and feature of the subject invention to provide a crimping tool with interleaving jaws adapted for substantially surrounding the crimp element to assure uniform anchoring and contact with the receiving member and to minimize cocking of the crimp element during the crimping operation.

It is yet another object and feature of the subject invention to provide a crimping tool having a notch configuration for maximizing the crimping force applied to the crimp element by the lever action of the jaws.

It is an additional object and feature of the subject invention to provide a crimping tool with an integral crimp element removal device for removing the crimp element from a receiving member in a non-destructive manner.

Other objects and features of the subject invention will be readily apparent from the accompanying drawings and detailed description of the preferred embodiments.

DETAILED DESCRIPTION OF THE PREFERRED EMBODIMENTS

Figure 10:
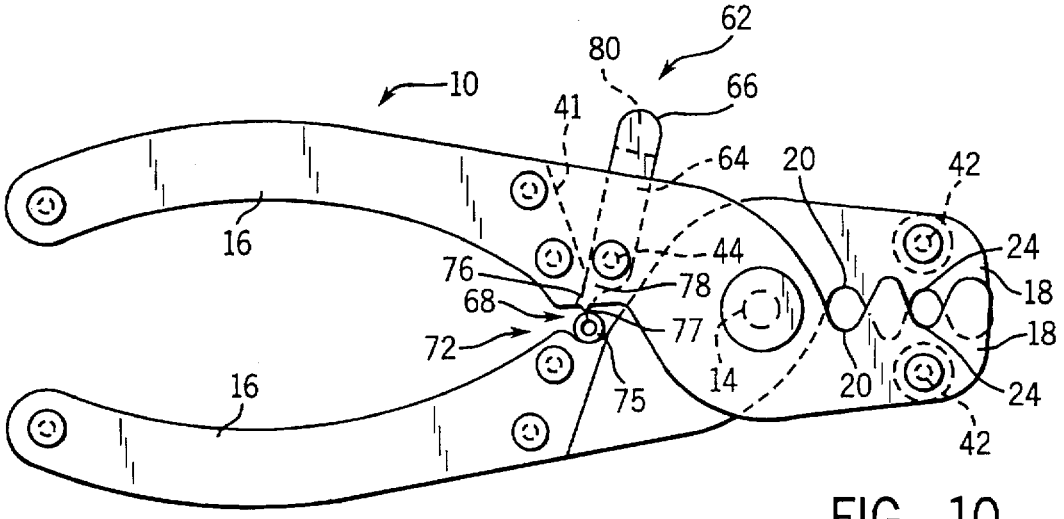
FIG. 10 is illustration looking in the same direction of FIG. 1 and showing an alternative embodiment of the crimping tool including an integral crimp removal device.
Figure 11:
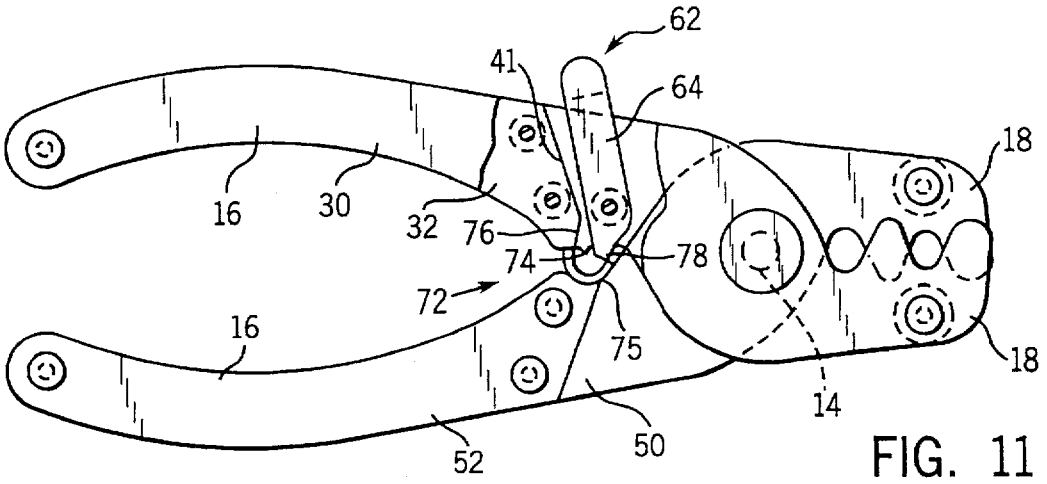
FIG. 11 is an illustration of the crimping tool of FIG. 10, showing the removal device in the crimp element spreading position.

The preferred embodiment of the crimping tool is shown in FIGS. 1–9, with an optional integral crimp removal device being illustrated in FIGS. 10 and 11. With specific reference to FIGS. 1–3, the crimping tool of the subject invention comprises a pair of handle/jaw assemblies 10, 12 for forming a pliers-type assembly pivoting about the pivot point 14. In the preferred embodiment, the handle/jaw assemblies are constructed of spring steel. However, it will be readily understood by those skilled in the art that other rigid materials could be substituted. As drawn, the handle portion 16 of each handle/jaw assembly is rearward, or to the right of the pivot point 14 and the jaw portion 18 if forward or to the left of the pivot point. Each assembled jaw includes at least one "v" shaped notch 20 adapted for receiving a crimp element 22. Typically, additional notches such as the notches 24 are provided for accommodating a plurality of varying sized crimp elements.

Figure 1:
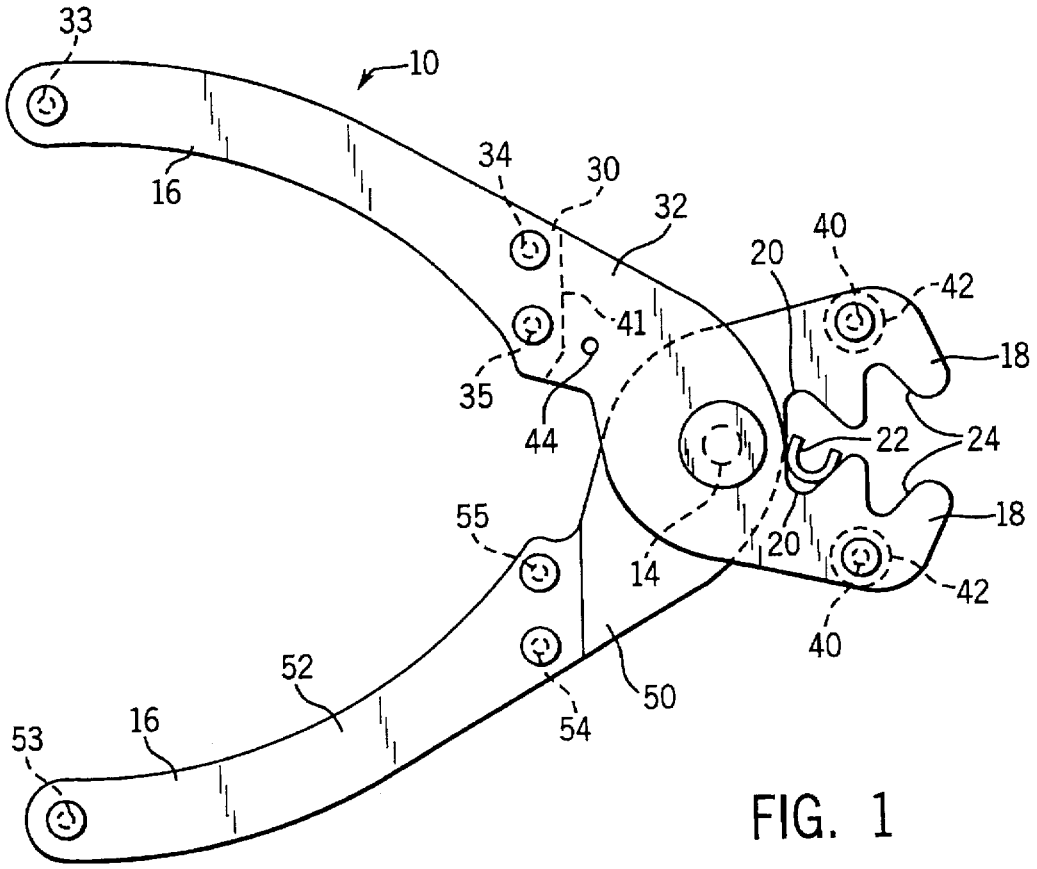
FIG. 1 is a first embodiment of the crimping tool of the subject invention, with the tool shown in the open position.
Figure 2:
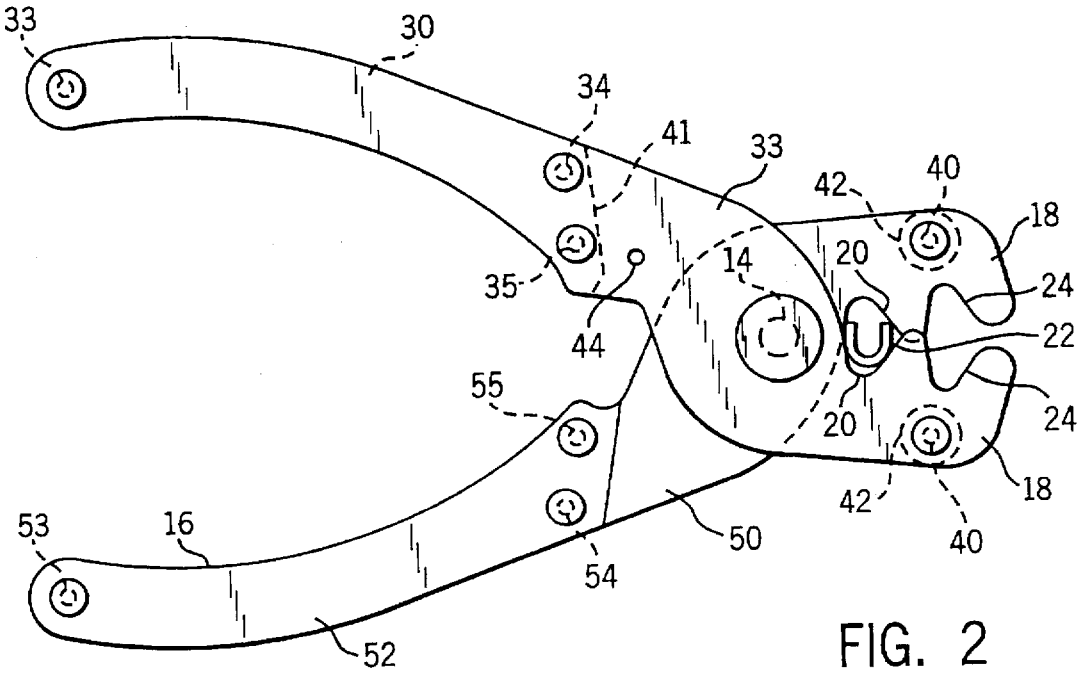
FIG. 2 is an illustration of the crimping tool of FIG. 1, shown in a partially closed position.
Figure 3:
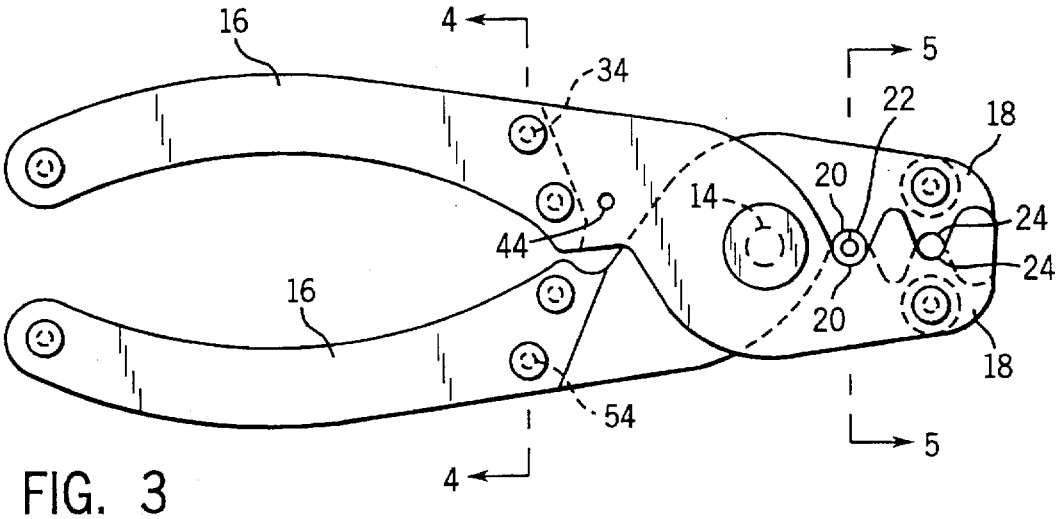
FIG. 3 is an illustration of the crimping tool of FIG. 1, shown in a fully closed position.

In the preferred embodiment, each notch 20, 24 and the like is of a deep "v" configuration, with a radiused closed end. The deep "v" multiplies the lever force applied directly to the crimp element 22 by redirecting the forces in the desired direction. As can be better seen in FIG. 2, as the interleaving jaws close, the crimp element is completely surrounded by the mated notch walls. Referring now to FIG. 3, when the tool is completely closed, the crimp element is firmly engaged by the jaw walls, with a uniform closing force being applied about the entire periphery of the element 22.

Figure 4:
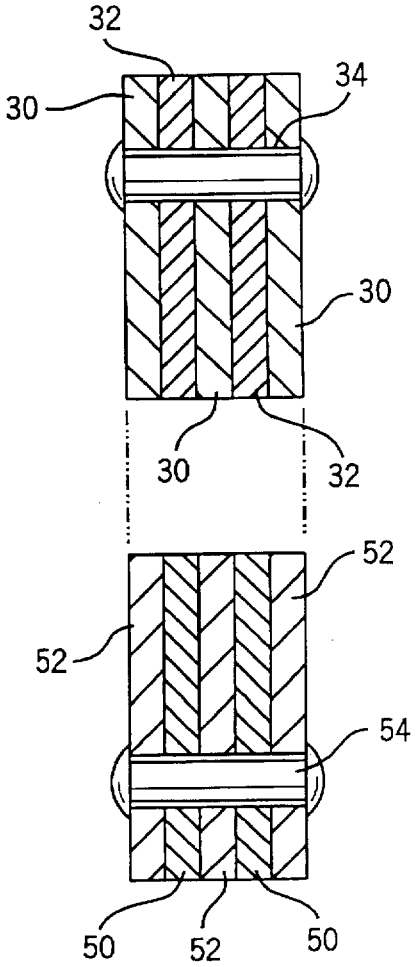
FIG. 4 is a sectional view taken along line 4—4 of FIG. 3, showing the laminated handle assembly.
Figure 5:
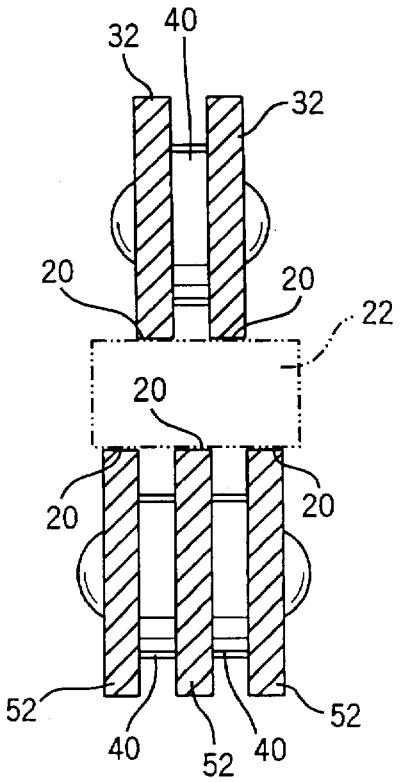
FIG. 5 is a sectional view taken along line 5—5 of FIG. 4, showing the laminated, interleaved jaw assembly.

The layered or laminated interleaving assembly is best seen in FIGS. 4 and 5, which are sectional views taken along lines 4—4 and 5—5, respectively, of FIG. 3. Referring first to FIG. 4, it will be noted that the handle portion 16 is made of a series of three handle plates 30 interleaved with two spacer plates 32. In the preferred embodiment, the plates 30 and 32 are each stamped from a 0.020 inch thick blued spring steel, making the assembled upper handle approximately 0.100 inch thick.

Figure 6:
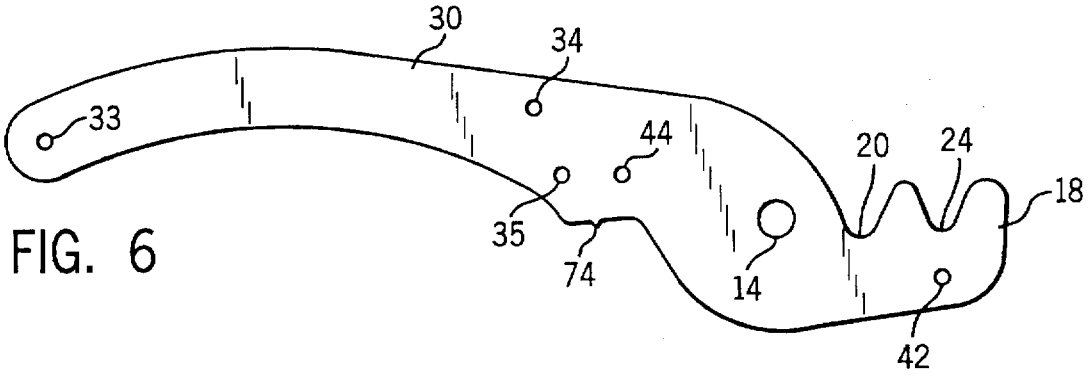
FIG. 6 is an illustration of an upper handle/lower jaw element.
Figure 7:
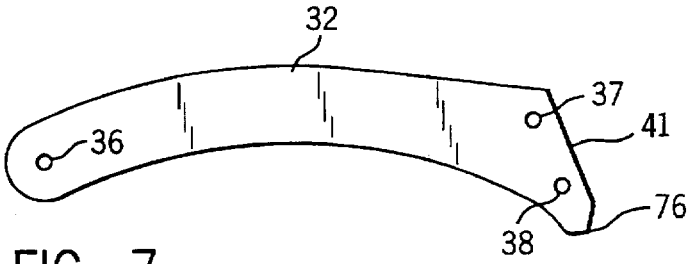
FIG. 7 is an illustration of an upper handle/lower jaw spacer.

As best seen in FIG. 6, each upper handle plate 30 includes a plurality of through mounting holes 33, 34 and 35. As shown in FIG. 7, each spacer plate 32 includes a plurality of complementary through mounting holes 36, 37 and 38. The perimeter of the handle plate 30 and the spacer plate 32 are in substantial alignment with one another when the upper handle/lower jaw is assembled, with the front end wall 40 spaced rearwardly from the pivot point defined by through hole 14. In the preferred embodiment, the handle and spacer plates are held in layered assembly by rivets in the mated mounting holes 33–38. The forward end of each handle plate 30 includes the jaw portion 18 with the crimp element receiving notches 20 and 24. As best seen in FIG. 5, the jaw sections are spaced by the spacer plates 32 provided in the handle. In order to provide rigidity to the jaw, a plurality of spacer washers 40 may be interleaved with each pair of plates 30 (see FIG. 1). A through mounting hole 42 is provided in each plate 30, through which a rivet or other pin element may be inserted for holding the washers 40 in assembled position.

Where desired, the handle plates 30 may be provided with a through mounting hole 44 for mounting the crimp removal or spreader tool, as will be described.

Figure 8:
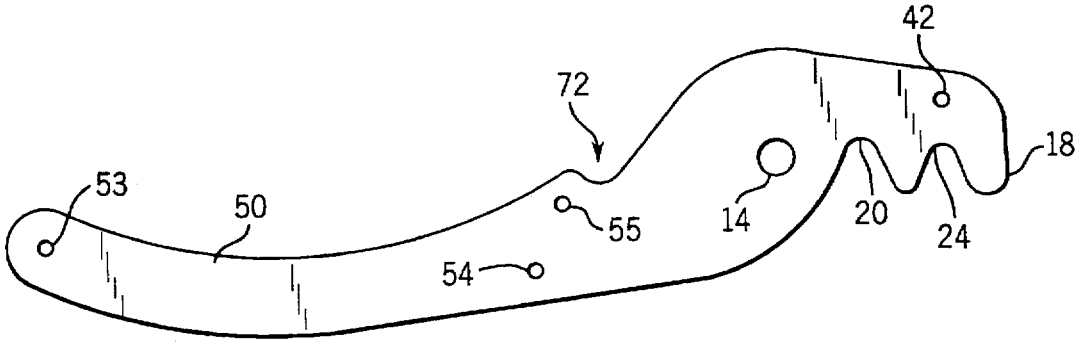
FIG. 8 is an illustration of a lower handle/upper jaw element.
Figure 9:
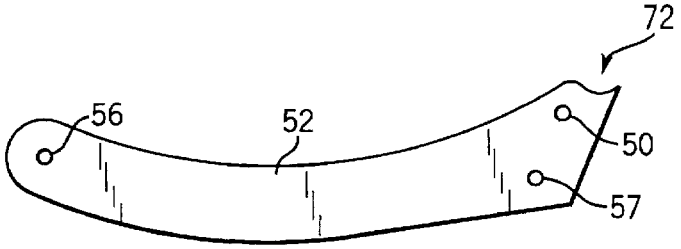
FIG. 9 is an illustration of a lower handle/upper jaw spacer.

The lower handle/upper jaw assembly 12 is constructed in a similar manner, with the exception that in the preferred embodiment, there are two handle plates 50, positioned in alignment with the upper spacer plates 32 and three spacer plates 52, positioned in alignment with the upper handle plates 30, as shown in FIG. 4. As best seen in FIG. 8, each lower handle plate 50 includes a plurality of through mounting holes 53, 54 and 55. As shown in FIG. 7, each spacer plate 52 includes a plurality of complementary through mounting holes 56, 57 and 58. The perimeter of the handle plate 50 and the spacer plate 52 are in substantial alignment with one another when the lower handle/upper jaw is assembled, with the front end wall 60 spaced rearwardly from the pivot point defined by through hole 14. In the preferred embodiment, the handle and spacer plates are held in layered assembly by rivets in the mated mounting holes 53–58. The forward end of each handle plate 30 includes the jaw portion 18 with the crimp element receiving notches 20 and 24. As best seen in FIG. 5, the jaw sections are spaced by the spacer plates 52 provided in the handle. In order to provide rigidity to the jaw, a plurality of spacer washers 40 may be interleaved with each pair of plates 30 (see FIG. 1). A through mounting hole 42 is provided in each plate 30, through which a rivet or other pin element may be inserted for holding the washers 40 in assembled position.

A modification to the preferred embodiment is shown in FIGS. 10 and 11, and includes a decrimping tool 62 pivotally mounted at hole 44 in the space between the front end wall 41 of the upper spacers 32 and the pivot point 14. As there shown, the decrimping tool 62 comprises a lever 64 having an upper handle or engagement portion 66 which extends beyond the upper handle assembly 10 and a lower tool end 68 extending into the area 70 between the upper handle 10 and the lower handle 12. In the preferred embodiment, the lower handle assembly 12 includes a rounded seat 72 for seating the crimp element 75 in the decrimping position. As better seen in FIG. 11, the upper handle assembly includes a nipple 74 extending into the decrimping zone 70 (also see FIG. 6). As shown in FIG. 7, the upper spacer plate 32 is cut away at 76 to permit the lever 64 to align with the nipple 74. As best seen in FIG. 11, the lever 64 includes a crimp ring engaging tip 78, which is initially in alignment with the nipple 74 (see FIG. 10).

In operation, the crimp element 75 is placed in the seat 72 with the split 77 of the element positioned upwardly and in alignment with the nipple 74 and the lever tip 78. The tool is then closed as shown in FIG. 10., with the nipple and lever tip entering the split area. The thumb is then used to press down and back on the lever handle area 66 as shown in FIG. 11 to advance the tip 78 forward and spread the element 75 between the nipple 74 and the tip 78, permitting non-destructive removal of the crimp element.

In the preferred embodiment, the lever assembly maybe constructed of a plurality of layers interleaved between the handle plates 30. A series of spacers 80 may be positioned between the lever layers to provide rigidity and to provide a more comfortable thumb engagement zone.

While specific embodiments and features of the invention have been described in detail herein, it will be readily understood the invention includes all of the modifications and enhancements within the scope and spirit of the following claims.

What is claimed is:

1. A pliers-type, lever action crimping tool comprising:

a. a first component including an integral upper handle end and a lower jaw end;

b. a second component including an integral lower handle end and an upper jaw end, said second component pivotally mounted relative to the first component intermediately of the handle ends and the jaw ends, the first and second components pivotable and offset opposite one another about the pivot point such that the jaw ends may be moved from a fully opened position with the jaws separated for defining an open mouth to a progressively closed position wherein the jaws are in overlapping engagement with one another;

c. each jaw end comprising a plurality of spaced plates positioned such that the offset jaw ends are in interleaving juxtaposition when in overlapping engagement;

d. each component including at least one crimp element receiving notch, wherein the notches are disposed opposite one another to define a crimp area and the crimping action is accomplished by closing the notches past the pivot point such that an element to be crimped is completely circumscribed by opposite, offset notches, e. wherein the jaws, when separated, permit the crimp element to be passed between the jaws ends back to the crimp area and f. a decrimping tool pivotally mounted on one of the components, the other of the components including a seat for defining a decrimping operating zone and for receiving and positioning a crimp element in the operating zone.

2. The crimping tool of claim 1, said one of said components including a crimp engaging element positioned in the decrimping operating zone.

3. The crimping tool of claim 1, wherein the decrimping tool further comprises a lever mounted on one component and having a crimp engaging tip extending into the decrimping operating zone, the lever further including a handle extending outwardly from the said one component.

4. The crimping tool of claim 3, wherein said lever comprises a plurality of interleaved lever plates.

5. The crimping tool of claim 2, wherein said crimp engaging element is a nipple extending from said one component.

6. The crimping tool of claim 2, wherein the operating zone is defined by a rounded notch in the other handle and positioned rearwardly of the pivot point.

7. A pliers-type, lever action crimping tool, comprising:

a. a first component including an upper handle end and a lower jaw end;

b. a second component including a lower handle end and an upper jaw end and pivotally mounted relative to the first component intermediately of the handle ends and the jaw ends, the first and second components pivotable relative to each other such that the jaw ends may be moved between a fully opened position and progressively overlapping engagement position with one another;

c. each jaw end comprising a plurality of spaced plates positioned such that the jaw ends are in interleaving juxtaposition when in overlapping engagement;

d. an integral decrimping tool mounted on one of the components, the other of the components including a seat for defining a decrimping operating zone and for receiving and positioning a crimp element in the operating zone; and e. wherein the decrimping tool further comprises a lever mounted on one component and having a crimp engaging tip extending into the decrimping operating zone, the lever further including a handle extending outwardly from the said one component.

8. The crimping tool of claim 7, said one of said components including a crimp engaging element positioned in the decrimping operating zone.

9. The crimping tool of claim 7, wherein said lever comprises a plurality of interleaved lever plates.

10. The crimping tool of claim 8, wherein said crimp engaging element is a nipple extending from said one component.

11. The crimping tool of claim 8, wherein the operating zone is defined by a rounded notch in the other handle and positioned rearwardly of the pivot point.

* * * * *